US006703587B2

(12) United States Patent
Sena et al.

(10) Patent No.: US 6,703,587 B2
(45) Date of Patent: Mar. 9, 2004

(54) POWERING HAIRSTYLING IMPLEMENTS

(75) Inventors: Michael F. Sena, Newington, CT (US); Santo DiMascio, Rocky Hill, CT (US)

(73) Assignee: System One Innovations Inc., Rocky Hill, CT (US)

( * ) Notice: Subject to any disclaimer, the term of this patent is extended or adjusted under 35 U.S.C. 154(b) by 0 days.

(21) Appl. No.: 10/160,712

(22) Filed: May 30, 2002

(65) Prior Publication Data

US 2003/0222069 A1 Dec. 4, 2003

(51) Int. Cl.[7] ..... A45D 1/04

(52) U.S. Cl. ..... 219/222; 219/541; 219/242; 392/385; 34/90; 34/97; 132/211; 132/229; 132/286

(58) Field of Search ..... 219/222–226, 219/541, 242, 477, 479; 392/384–385; 132/210–211, 219, 120, 229–232, 269, 286, 333, 314; 34/283, 90–91, 96–97

(56) References Cited

U.S. PATENT DOCUMENTS

| | | | | | |
|---|---|---|---|---|---|
| 1,650,241 | A | * | 11/1927 | Stenholm | 132/286 |
| 1,863,341 | A | * | 6/1932 | Jensen | 132/210 |
| 2,261,747 | A | * | 11/1941 | Vegh | 132/120 |
| 3,084,700 | A | * | 4/1963 | Fischer et al. | 132/120 |
| 3,095,523 | A | * | 6/1963 | Stith | 132/120 |
| 3,220,421 | A | * | 11/1965 | Van Droogeubroek et al. | 219/225 |
| 3,445,628 | A | * | 5/1969 | Bateman, Sr. | 392/436 |
| 3,938,873 | A | | 2/1976 | Kimball | |
| 3,955,064 | A | * | 5/1976 | Demetrio et al. | 219/225 |
| 4,101,756 | A | * | 7/1978 | Yamano | 219/222 |
| 4,103,145 | A | * | 7/1978 | Oliveri | 219/222 |
| D256,637 | S | | 9/1980 | Chiklis | |
| 4,267,430 | A | * | 5/1981 | Downey | 439/653 |
| 5,124,532 | A | | 6/1992 | Hafey et al. | |
| 5,220,931 | A | * | 6/1993 | Aida | 132/233 |
| 5,547,393 | A | | 8/1996 | Jansen | |
| 5,577,819 | A | * | 11/1996 | Olsen | 312/242 |
| 5,749,379 | A | | 5/1998 | Stillwagon et al. | |
| 5,798,500 | A | | 8/1998 | Stillwagon, Jr. et al. | |
| 5,917,694 | A | | 6/1999 | Denny | |
| 5,951,894 | A | * | 9/1999 | White, Jr. | 219/222 |
| 6,043,457 | A | * | 3/2000 | Hashimoto | 219/223 |
| 6,305,388 | B1 | * | 10/2001 | Zeller | 132/314 |

FOREIGN PATENT DOCUMENTS

| | | | | |
|---|---|---|---|---|
| FR | 24527 | * | 8/1922 | 219/225 |
| JP | 5-337007 | * | 12/1993 | 392/385 |

* cited by examiner

*Primary Examiner*—John A. Jeffery
(74) *Attorney, Agent, or Firm*—Fish & Richardson P.C.

(57) ABSTRACT

An associated set of hair styling appliances is electrically powered by a single power cord, reducing cord clutter in salon workstations. When not in use the appliances are stored in an electrically powered appliance rack that preheats hair irons and other heated appliances. A method of styling hair features connecting the single power cord to one of the appliances to style hair in a first sense, then disconnecting the power cord from the appliance and connecting the cord to another of the appliances to style hair in a second sense.

27 Claims, 4 Drawing Sheets

POWERING HAIRSTYLING IMPLEMENTS

TECHNICAL FIELD

This invention relates to powering hairstyling appliances, and more particularly to organizing and electrically connecting electrical hairstyling appliances.

BACKGROUND

Modern hairstyling in professional salons involves the use of many electrically powered, hand-held styling implements or appliances, such as hair clippers and edgers, irons of various shapes, such as curling and flat irons, and blow-dryers, for example. As the styling of an individual customer's hair may require the use of several such appliances during a single appointment, and a professional stylist is apt to have several customers through the course of a day, it is desirable to keep all such appliances handy and ready for use. For irons in particular, readiness necessitates that the iron be pre-heated to a useful temperature for pressing hair.

Although cordless appliances have been available for some time (see, e.g., U.S. Pat. No. 5,124,532 to Hafey et al.), the intensive duty cycles of appliances in high-volume salons are such that many hair stylists prefer the reliable power of corded appliances running on 110 volt AC power, plugged into standard wall receptacles.

Unfortunately, having several appliances constantly plugged in and preheated at a single hairstyling workstation can result in a cluttered, unprofessional workstation appearance. Furthermore, sequential use of several appliances over the course of a day can result in frustrating and potentially hazardous cord entanglement. Such frustrations have been known to barbers and hairstylists for a long time.

SUMMARY

According to one aspect of the invention, a method of styling hair, such as human hair, is provided. The method includes connecting an electrical power cord to a first styling appliance, styling the hair in a first sense with the first styling appliance (with the power cord connected to, and electrically powering, the first styling appliance), disconnecting the power cord from the first styling appliance, connecting the disconnected power cord to a second styling appliance, and then styling the hair in a second sense with the second styling appliance (with the power cord connected to, and electrically powering, the second styling appliance).

In some cases, the method also includes, after disconnecting the power cord from the first styling appliance, placing the first styling appliance in one of multiple receptacles of a hair styling appliance holder.

In some situations, the receptacle in which the first styling appliance is placed includes electrical contacts for electrically powering the first styling appliance while in the receptacle. Only some of the receptacles of the appliance holder include electrical contacts for powering appliances, in some embodiments. Preferably, the electrical contacts of the receptacle are arranged to engage electrical contacts of the first styling appliance exposed by the disconnecting of the power cord from the first styling appliance.

In some embodiments the first styling appliance is an iron, with the method including heating the iron in the appliance holder receptacle. In some cases, the second styling appliance is an iron of a different shape than that of the first appliance iron, with the method including, prior to connecting the power cord to the second styling appliance, removing the second styling appliance from another of the multiple receptacles of the appliance holder.

The 'first sense' in which the hair is styled may include blow-drying the hair, with the 'second sense' involving ironing the hair, in one example. In another example, the 'first sense' involves ironing the hair with an iron of a first shape, and the 'second sense' includes ironing the hair with an iron of a second shape.

Disconnecting the power cord from the first appliance preferably requires moving the cord in a first direction with respect to the appliance, and then moving the cord in a second direction with respect to the appliance.

In some constructions, the power cord is connected to the first and second appliances with a twist-lock connector.

In some embodiments, the appliances each have a main housing carrying a corresponding power switch. The power cord directly engages electrical contacts within the housings of the appliances when connected. For example, the electrical contacts of the appliance housings may be male contacts extending into cavities defined within the housings.

In some applications in which the second styling appliance is a hair iron, the method includes, while styling the hair with the first styling appliance, preheating the hair iron in one of multiple receptacles of a hair styling appliance holder.

According to another aspect of the invention, a hair styling appliance rack includes a housing defining multiple receptacles configured to receive hair styling appliances between uses, with at least one of the receptacles featuring electrical contacts for engaging and electrically powering a hair styling appliance placed in the receptacle.

In some embodiments, two of the receptacles include electrical contacts, for simultaneously powering two corresponding appliances placed in the receptacles.

In some configurations, the housing includes a base defining a first set of the receptacles, and an iron-warming tray removably attached to the base and defining a second set of the receptacles, such as those with electrical contacts. The iron-warming tray has multiple receptacles with associated contacts, in some embodiments, for simultaneously preheating two hair irons.

In some instances, the electrical contacts are exposed in holes defined in an exterior rack surface within their associated receptacle and arranged to receive male contacts of a hair styling appliance housing. Preferably, the receptacle with electrical contacts further includes a latch for securely retaining a styling appliance upon the rack during electrical powering. The latch may include twist-lock features configured to engage mating twist-lock features on a styling appliance, for example.

According to a third aspect of the invention, an associated set of hair styling appliances is provided. The set includes at least a blow-dryer and a hair iron. Each of the appliances has a graspable housing defining a corresponding electrical connector configured so as to releasably connect to a common power cord for selectively powering any one of the appliances, and sequentially powering any two of the appliances, with the common power cord.

The terms "appliances" and "implements" are used interchangeably throughout this document.

Various aspects of the invention can provide significant advantages to the hair stylist or salon owner. Workstation safety and appearance can be greatly improved by a reduction in cord clutter and entanglement, and by providing a powered preheating rack for heated appliances specifically fashioned for hair styling.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
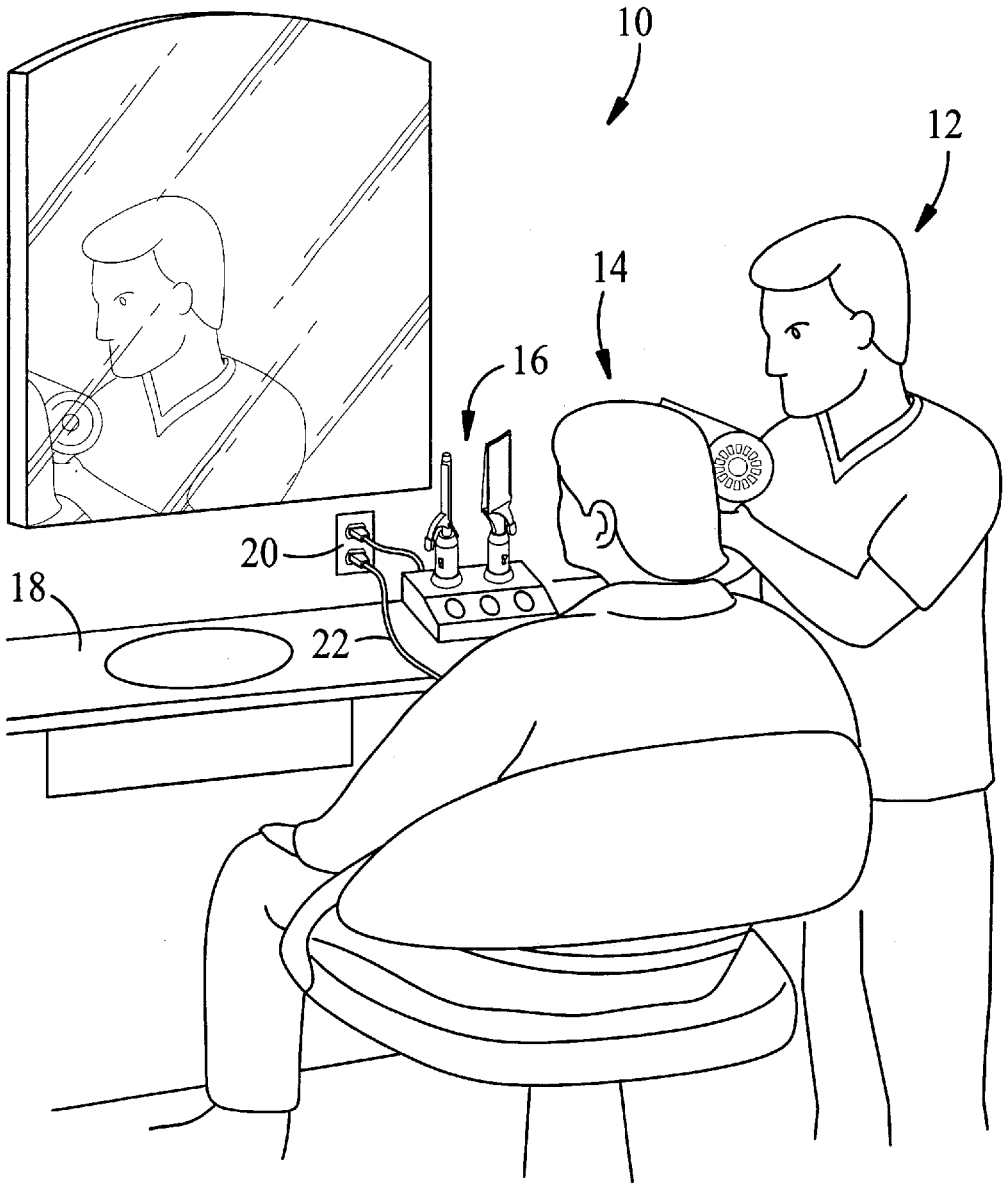
FIG. 1 shows a stylist using a set of related appliances to cut and style a customer's hair.

FIG. 1 illustrates a hair styling workstation 10 in which a stylist 12 is sequentially employing several of a set of related, hand-held electrical styling implements to cut and style the hair of a customer 14. An appliance rack 16 is installed upon a counter 18 in easy reach of the stylist. Conveniently stored in the rack and ready for immediate use are a pair of irons and a hair clipper. Rack 16 is plugged into a standard wall receptacle 20, as is a single power cord 22 configured to power each of the appliances, as described below. Advantageously, only power cord 22 extends over the edge of counter 18 at any given time, as the appliances stored in rack 16 do not have connected cords when not in use. Thus, there is no multiplicity of cords to become tangled as the stylist moves around the customer in the course of styling.

Figure 2:
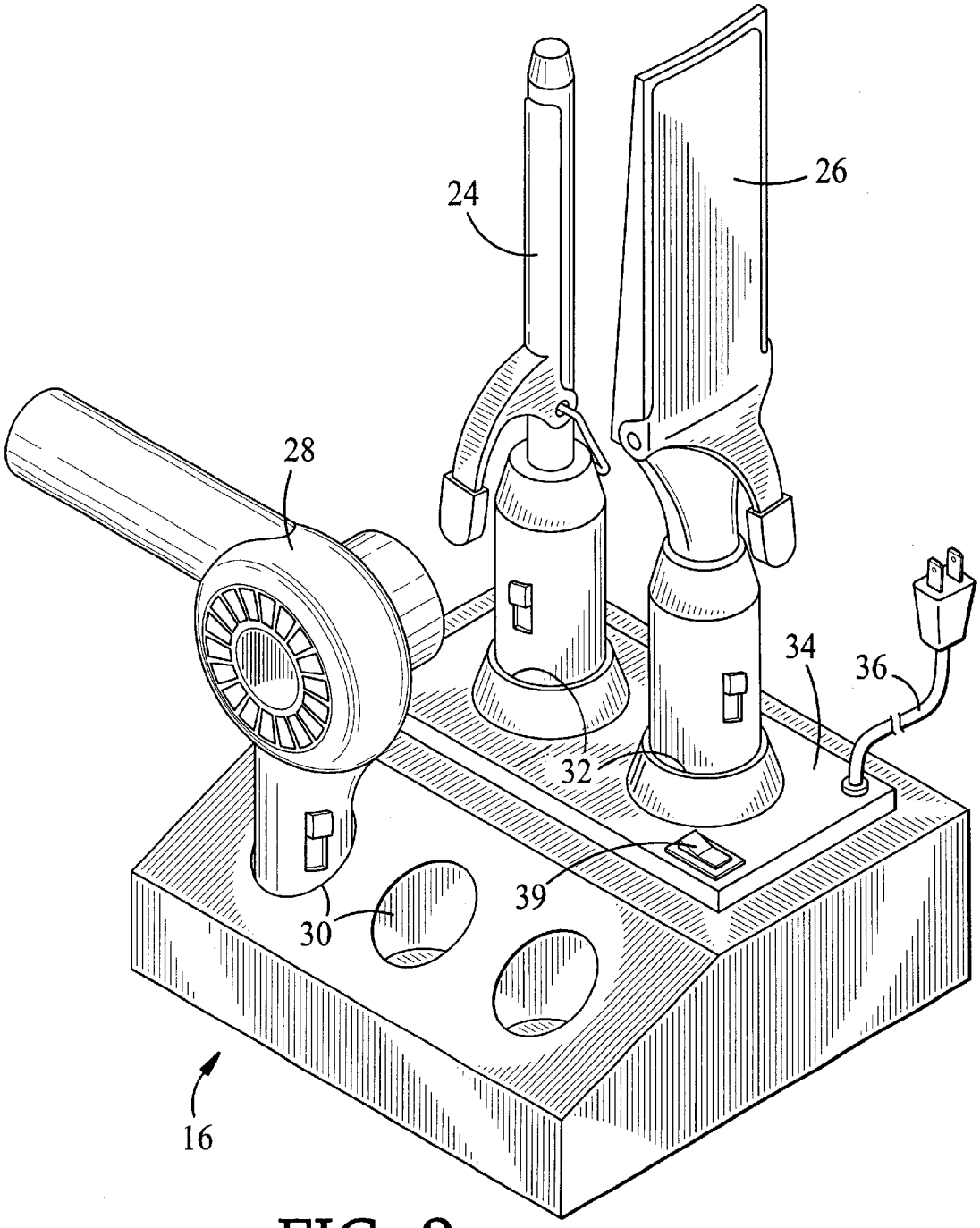
FIG. 2 is a perspective view of a hair appliance rack with related appliances.

As illustrated in FIG. 2, rack 16 is configured to simultaneously hold multiple appliances. In this particular illustration, a curling iron 24, a flat iron 26 and a blow-dryer 28 are shown, with two additional non-powered appliance receptacles 30 unoccupied. The number and arrangement of non-powered receptacles 30, and powered receptacles 32 for preheated appliances such as irons, varies among embodiments. In this case the powered receptacles 32 are defined within an electric plate 34 that is connectable to a standard power receptacle by cord 36. Receptacles 30 and 32 are shown as round cavities configured to hold stored appliances in an upright position, but their shape and orientation may be varied to suit particular appliances or preference. In particular, non-powered receptacles 30 may be alternatively configured as slots or hooks, for example, in or on which appliances are hung or placed when not in use. Powered receptacles 32 are preferably arranged to keep the heated portions of stored irons from contacting heat-sensitive or thermally conductive surfaces, and to present the irons exposed for easy grasping by the stylist.

Figure 3:
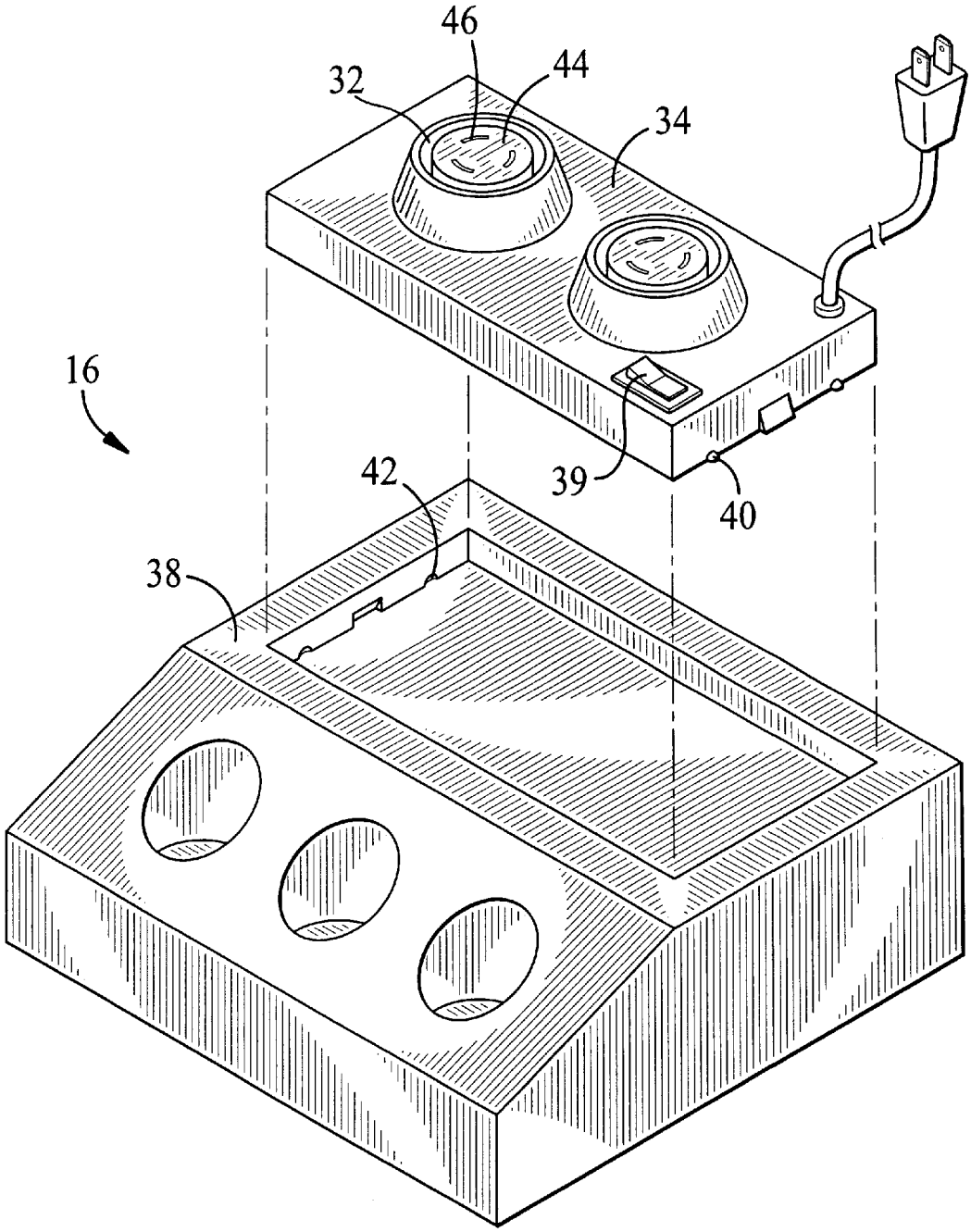
FIG. 3 is an exploded view of the appliance rack of FIG. 2, with appliances removed.

Referring next to FIG. 3, optional warming plate 34 is releasably secured within a cavity in the upper surface of rack base 38, and held in place by protrusions 40 engaging associated detents 42. Within each powered receptacle 32 is a raised platform 44 defining slots 46 in which female electrical contacts (not shown) are exposed for engaging related male contacts of an appliance. Preferably, platform 44 is configured as one-half of a twist-lock electrical connector, such that a related appliance is both mechanically secured to plate 34 and electrically connected for preheating by inserting the handle end of the appliance into the receptacle in a vertical motion, then rotating the appliance with respect to plate 34 to firmly seat the appliance and secure against unintended disconnection. It is preferred that the exposed upper surface of plate 34 be disposed sufficiently high above any working countertop, as mounted on rack base 38, to avoid the risk of spilled liquids entering receptacles 32. A fused power switch 39 controls power to receptacles 32.

Figure 4:
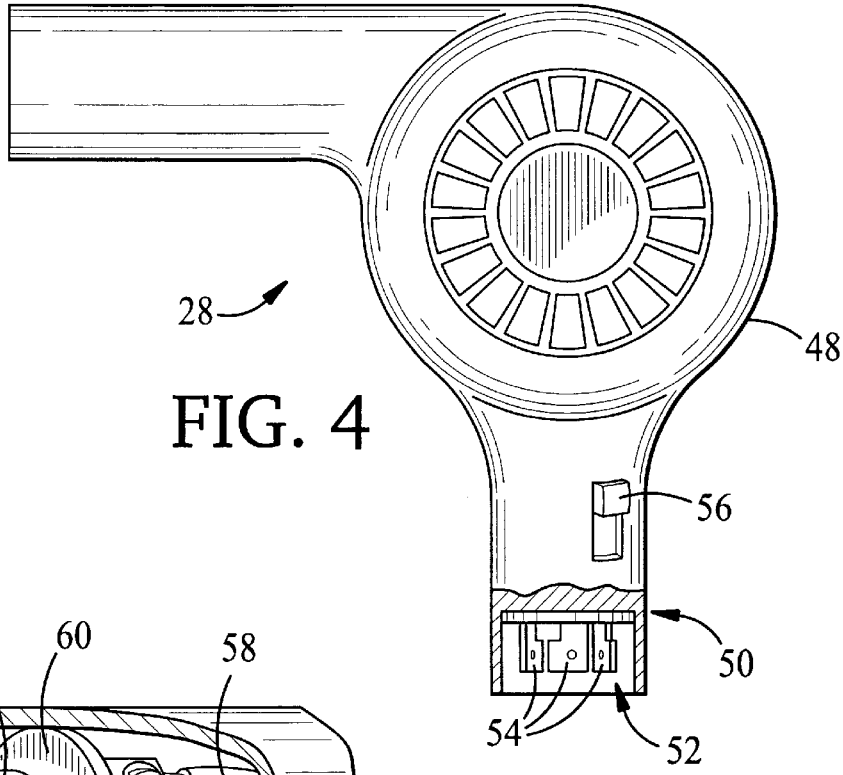
FIG. 4 is a side view of a blow-drying appliance, partially cut away to illustrate the integral connector.

FIG. 4 shows a representative construction of one of the associated set of appliances. Blow-dryer 28 has a clamshell, injection-molded plastic housing 48 that defines, in the handle end 50, a cavity 52 for receiving an associated power cord. Male contacts 54 extend into cavity 52 and are exposed to engage female contacts (not shown) of the cord. Preferably, the distal rim of the handle end of housing 48 extends to beyond the extent of contacts 54 to protect the contacts from accidental damage. Appliance housing 48 also carries a switch 56 for selectively connecting power supplied through contacts 54 to an enclosed load such as fan motor and/or heating element (not shown).

Figure 5:
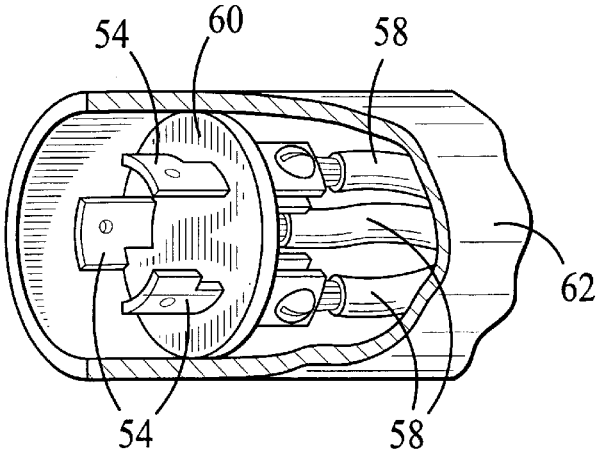
FIG. 5 is a partial cut-away view of a handle end of a hair iron, showing male connector construction.

FIG. 5 illustrates a similar male connector arrangement in the handle end of a hair iron. Contacts 54 are each electrically connected to associated conductors 58. An insulating contact carrier plate 60 is retained within the assembled clamshell housing 62 of the appliance by appropriately located and integrally molded housing features (not shown). In hair irons and other appliances with extended preheat times, it is preferred that the configuration of the connector portion of the appliance housing be selected to electrically connect both to the associated power cord and to the powered receptacles of the warming plate of the appliance rack, as discussed above with respect to FIG. 3.

Figure 6:
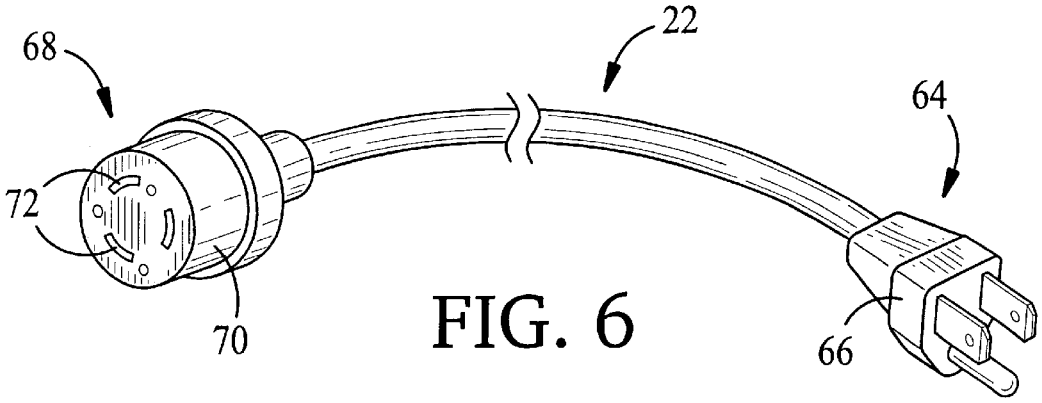
FIG. 6 is a perspective view of a related power cord, with one end defining a female connector adapted to releasably connect to the connectors illustrated in FIGS. 4 and 5.

FIG. 6 illustrates the power cord 22 configured to be selectively connected to any of the hair styling appliances of the above-described system. A wall end 64 of the cord is in the form of a standard 3-prong AC plug 66 for use with standard wall receptacles. As configured for other countries with different styles of standard receptacles, the wall end 64 of cord 22 will have an appropriate arrangement of contacts. The appliance end 68 of cord 22 forms a female socket plug 70 defining slots 72 in which female electrical contacts (not shown) are exposed for engagement by associated male contacts of the above-described appliances. Slots 72 are defined in a planar distal face of plug 70.

Preferred styles of electrical connectors for the appliance end of cord 22, and for integration into housings of the associated set of appliances include twist-lock 2 pole, 3 wire grounding locking connectors, such as flanged inlet 2315 (male) and connector 2313 (female) from Leviton Mfg. Company Inc., of Little Neck, N.Y. These particular connectors are rated for 20 amps at 125 volts. Several other styles are available from the same source.

Other means of electrically and mechanically connecting the cord and appliances include, for example, button-release, squeeze-lock, snap-on and other known types of latching connectors. Non-latching electrical connectors may also be employed, if sufficient care is taken that the connector not be inadvertently disconnected while in use.

Referring back to FIG. 1, in use a stylist will be able to connect power cord 22 to a first styling appliance, such as a hair clipper, style a customer's hair in a first sense (e.g., cutting) with the first styling appliance, with the power cord connected to, and electrically powering, the first styling appliance. The stylist will then be able to disconnect the power cord from the first styling appliance and connect the disconnected power cord to a second styling appliance, such as a hair iron, and then style the hair in a second sense (e.g., ironing) with the second styling appliance, with the power cord connected to, and electrically powering, the second styling appliance. By using the same cord 22 to power both appliances in sequence, cord entanglement is eliminated. Furthermore, appliance organization is simplified and workstation 10 provided with a more professional appearance as stored appliances have no associated cords draping across counter space and about rack 16.

A number of embodiments of the invention have been described. Nevertheless, it will be understood that various modifications may be made without departing from the spirit and scope of the invention. For example, the methods and devices described herein are readily suitable for pet grooming, and for personal, in-home use. Accordingly, other embodiments are within the scope of the following claims.

What is claimed is:

1. A method of styling human hair, the method comprising connecting an electrical power cord to a first styling appliance having a handle;

styling the hair in a first sense with the first styling appliance, with the power cord connected to, and supplying electrical power to operate, the first styling appliance;

disconnecting the power cord from the first styling appliance;

connecting the disconnected power cord to a second styling appliance having a handle; and styling the hair in a second sense with the second styling appliance, with the power cord connected to, and supplying electrical power to operate, the second styling appliance.

2. The method of claim 1 further including, after disconnecting the power cord from the first styling appliance, placing the first styling appliance in one of multiple receptacles of a hair styling appliance holder.

3. The method of claim 2 wherein the receptacle in which the first styling appliance is placed includes electrical contacts for electrically powering the first styling appliance while in the receptacle.

4. The method of claim 3 wherein only some of the receptacles of the appliance holder include electrical contacts for powering appliances.

5. The method of claim 3 wherein the electrical contacts of the receptacle are arranged to engage electrical contacts of the first styling appliance exposed by the disconnecting of the power cord from the first styling appliance.

6. The method of claim 3 wherein the first styling appliance comprises an iron, the method including heating the iron in the appliance holder receptacle.

7. The method of claim 6 wherein the second styling appliance comprises an iron of a different shape than that of the first appliance iron, the method including, prior to connecting the power cord to the second styling appliance, removing the second styling appliance from another of the multiple receptacles of the appliance holder.

8. The method of claim 1 wherein the first sense comprises blow-drying the hair, and wherein the second sense comprises ironing the hair.

9. The method of claim 1 wherein the first sense comprises ironing the hair with an iron of a first shape, and wherein the second sense comprises ironing the hair with an iron of a second shape.

10. The method of claim 1 wherein disconnecting the power cord from the first appliance requires moving the cord in a first direction with respect to the appliance, and then moving the cord in a second direction with respect to the appliance.

11. The method of claim 1 wherein the power cord is connected to the first and second appliances with a twist-lock connector.

12. The method of claim 1 wherein the first and second appliances each have a main housing carrying a corresponding power switch, and wherein the power cord directly engages electrical contacts within the housings of the appliances when connected thereto.

13. The method of claim 12 wherein the electrical contacts of the appliance housings are male contacts extending into cavities defined within the housings.

14. The method of claim 1 wherein the second styling appliance comprises a hair iron, the method further comprising, while styling the hair with the first styling appliance, preheating the hair iron in one of multiple receptacles of a hair styling appliance holder.

15. A method of styling human hair, the method comprising connecting an electrical power cord to a first styling appliance;

styling the hair in a first sense with the first styling appliance, with the power cord connected to, and electrically powering, the first styling appliance;

disconnecting the power cord from the first styling appliance;

connecting the disconnected power cord to a second styling appliance; and styling the hair in a second sense with the second styling appliance, with the power cord connected to, and electrically powering, the second styling appliance wherein one of the first and second senses comprises blow-drying the hair, and the other of the first and second senses comprises ironing the hair.

16. The method of claim 15 wherein the first sense comprises blow-drying the hair, and wherein the second sense comprises ironing the hair.

17. The method of claim 15 further including, after disconnecting the power cord from the first styling appliance, placing the first styling appliance in one of multiple receptacles of a hair styling appliance holder.

18. The method of claim 17 wherein the receptacle in which the first styling appliance is placed includes electrical contacts for electrically powering the first styling appliance while in the receptacle.

19. The method of claim 18 wherein only some of the receptacles of the appliance holder include electrical contacts for powering appliances.

20. The method of claim 18 wherein the electrical contacts of the receptacle are arranged to engage electrical contacts of the first styling appliance exposed by the disconnecting of the power cord from the first styling appliance.

21. The method of claim 18 wherein the first styling appliance comprises an iron, the method including heating the iron in the appliance holder receptacle.

22. The method of claim 15 wherein the first sense comprises blow-drying the hair, and wherein the second sense comprises ironing the hair.

23. The method of claim 15 wherein disconnecting the power cord from the first appliance requires moving the cord in a first direction with respect to the appliance, and then moving the cord in a second direction with respect to the appliance.

24. The method claim 15 wherein the power cord is connected to the first and second appliances with a twist-lock connector.

25. The method of claim 15 wherein the first and second appliances each have a main housing carrying a corresponding power switch, and wherein the power cord directly engages electrical contacts within the housings of the appliances when connected thereto.

26. The method of claim 25 wherein the electrical contacts of the appliance housings are male contacts extending into cavities defined within the housings.

27. The method of claim 15 wherein the second styling appliance comprises a hair iron, the method further comprising, while styling the hair with the first styling appliance, preheating the hair iron in one of multiple receptacles of a hair styling appliance holder.

* * * * *